US010348003B2

(12) United States Patent
Singhammer et al.

(10) Patent No.: US 10,348,003 B2
(45) Date of Patent: Jul. 9, 2019

(54) METHOD FOR ASSEMBLING AN ANGLED PLUG CONNECTOR

(71) Applicant: ROSENBERGER HOCHFREQUENZTECHNIK GMBH & CO. KG, Fridolfing (DE)

(72) Inventors: Martin Singhammer, Fridolfing (DE); Florian Hohenadl, Traunstein/Kammer (DE)

(73) Assignee: Rosenberger Hochfrequenztechnik GmbH & Co. KG, Munich (DE)

( * ) Notice: Subject to any disclaimer, the term of this patent is extended or adjusted under 35 U.S.C. 154(b) by 0 days.

(21) Appl. No.: 15/552,035

(22) PCT Filed: Feb. 18, 2016

(86) PCT No.: PCT/EP2016/000282
§ 371 (c)(1),
(2) Date: Aug. 18, 2017

(87) PCT Pub. No.: WO2016/138982
PCT Pub. Date: Sep. 9, 2016

(65) Prior Publication Data

US 2018/0034172 A1 Feb. 1, 2018

(30) Foreign Application Priority Data

Mar. 5, 2015 (DE) ..... 10 2015 002 832

(51) Int. Cl.
*H01R 9/05* (2006.01)
*H01R 43/20* (2006.01)
(Continued)

(52) U.S. Cl.
CPC ..... *H01R 9/0503* (2013.01); *H01R 13/514* (2013.01); *H01R 13/5202* (2013.01);
(Continued)

(58) Field of Classification Search
CPC ..... H01R 4/16; H01R 4/187; H01R 4/5066; H01R 9/0503; H01R 13/514;
(Continued)

(56) References Cited

U.S. PATENT DOCUMENTS 5,037,329 A * 8/1991 Wright ..... H01R 24/40 439/582
5,494,454 A * 2/1996 Johnsen ..... H01R 9/053 439/394
(Continued)

FOREIGN PATENT DOCUMENTS

DE 102012201123 B3 3/2013
EP 1580848 A1 9/2005

*Primary Examiner* — Travis S Chambers
(74) *Attorney, Agent, or Firm* — DeLio, Peterson & Curcio, LLC; Robert Curcio

(57) ABSTRACT

A method for assembling an angled plug connector with a plug connector housing, which has a through channel preferably angled at a right angle in order to receive conductor components extending at an angle relative to one another, wherein a first conductor component introduced from one side (X) into the through channel in the interior of the through channel is connected by non-positive and/or by positive engagement to a second conductor component introduced from the other side (Y) into the through channel. Additionally, an assembly unit for carrying out the method is presented.

18 Claims, 2 Drawing Sheets

(51) Int. Cl.

| | |
|---|---|
| ***H01R 13/514*** | (2006.01) |
| ***H01R 13/52*** | (2006.01) |
| ***H01R 24/56*** | (2011.01) |
| *H01R 4/16* | (2006.01) |
| *H01R 4/18* | (2006.01) |
| *H01R 4/50* | (2006.01) |

(52) U.S. Cl.
CPC ..... *H01R 24/56* (2013.01); *H01R 43/20* (2013.01); *H01R 4/16* (2013.01); *H01R 4/187* (2013.01); *H01R 4/5066* (2013.01); *H01R 9/05* (2013.01)

(58) Field of Classification Search
CPC .... H01R 13/5202; H01R 24/38; H01R 24/56; H01R 24/545; H01R 43/20; H01R 9/05; Y10S 439/902
USPC ..... 439/582, 655, 694, 827, 855, 881, 902
See application file for complete search history.

(56) References Cited

U.S. PATENT DOCUMENTS

| | | | | |
|---|---|---|---|---|
| 5,725,391 | A * | 3/1998 | Masuda | H01R 13/6582 439/582 |
| 6,860,761 | B2 * | 3/2005 | Lee | H01R 4/28 439/582 |
| 7,070,440 | B1 * | 7/2006 | Zerebilov | H01R 9/053 439/394 |
| 9,099,797 | B1 * | 8/2015 | Duesterhoeft | H01R 4/58 |
| 2011/0021075 | A1 | 1/2011 | Omer | |
| 2012/0214338 | A1 | 8/2012 | Nugent | |

* cited by examiner

METHOD FOR ASSEMBLING AN ANGLED PLUG CONNECTOR

BACKGROUND OF THE INVENTION

1. Field of the Invention

The present invention relates to a method for assembling an angled plug connector. The angled plug connector comprises a plug connector housing through which an angled through-channel designed to accommodate conductor components extending at an angle relative to one another passes. An angled through-channel is understood to mean a passage, not linear or not straight, running through the plug connector housing which can include a sudden change in direction, for example a bend by around 90°, in order to create a right-angled plug connector. A first conductor component in the interior of the through-channel, introduced into the through-channel from one side, is connected in a form- and/or force-locking manner with a second conductor component which is introduced into the through-channel from the other side.

2. Description of Related Art

Plug connectors are generally used for the detachable connection of electrical lines or other electrical components in order, in the coupled state, to allow the transmission of current and/or electrical signals. A first plug connector, for example a plug part, is thereby coupled with a complementary mating plug connector, for example a socket part.

A plug connector generally has a cable-side end, at which a line, for example a cable, emerges from the through-channel, and a plug-side end, at which the plug connector has a plug interface for coupling with the mating plug connector.

In the case of an angled plug connector, the longitudinal direction of the line emerging from the plug connector at the cable-side end and the plugging direction for coupling with the mating plug connector are oriented at an angle relative to one another, for example at a right angle. This makes possible a particularly space-saving coupling to a mating plug connector, and also avoids the necessity for laying a cable connected with the plug connector in a curve, which may render it susceptible to damage, since the plug connector itself defines the change in direction within a small space.

In other words, the through-channel of an angled plug connector comprises a first channel section in which the plug interface is accommodated and a second channel section, extending at an angle thereto, from which the cable emerges on the cable-side end.

Conventional angled plug connectors are manufactured as follows: first, a conductor component with an angled front section carrying the plug interface is mounted on an end of a cable, for example by means of crimping or soldering to the cable conductor. The angled conductor component is then introduced into a channel of a plug connector housing. For this purpose, two housing shells can be placed laterally, from two sides, onto the angled conductor component and then snap-locked together with one another. Alternatively, the angled conductor component is introduced from the side into an open housing, and the channel which is open at the side is then closed with a housing cover or the like.

If the angled plug connector is to be watertight, the two housing shells must be connected with one another in a sealed manner or the housing cover must close the housing in a sealed manner, for which purpose a sealing material or adhesive can for example be used. However, a watertight sealing of a plug connector housing at the location of final assembly of the plug connector is complicated and susceptible to errors, and its water tightness can diminish over time. Moreover, additional costs are incurred for the manufacture, transport and assembly of a multiple-part housing.

Known from the generically relevant publication DE 10 2012201123 B3 is an assembly method for an angled plug connector with a housing in which a cable-side outer conductor part (first outer conductor part) is pushed in a linear direction through a first opening into a cavity of the housing. The cable-side outer conductor part is fixed in the housing by snap-locking a cover onto the housing. An opening arranged on the side of the cable-side outer conductor part points in the direction of a second opening of the cavity of the housing. Through this second opening, a plug-side outer conductor part (second outer conductor part) is, in a subsequent step, arranged in the cavity of the housing and the cable-side outer conductor part and the plug-side outer conductor part are connected with one another in that a press-fit is created between these parts. At the same time, a cable-side inner conductor part (first inner conductor part) and a plug-side inner conductor part (second inner conductor part) are pressed together to form a press-fit.

Known from US 2011/0021075 is an angled electrical plug connector with a housing, whereby, in addition to an opening at a plug-side end and an opening at a cable-side end, an additional opening in a rear wall of the housing is provided on said housing. This additional opening provides access to a coupling joint of two inner conductor components for the purpose of connecting these with one another, electrically and mechanically, and visually checking their correct assembly within the housing. The additional opening is sealed with a cover following installation of the angled plug connector. However, this has the disadvantage that the housing is not formed in a single piece and an additional seal must be provided in the region of the additional opening.

SUMMARY OF THE INVENTION

In view of the problems described, it is the object of the present invention to provide a method for simplified assembly of an angled plug connector and at the same time to reduce the manufacturing costs. In particular, the aim is to provide a method which leads to an angled plug connector with excellent water tightness, without involving a major expenditure of time and effort in assembly.

According to the invention, this problem is solved through a further development of the conventional assembly method with the method steps according to the independent claims. At least one independent claim relates to an assembly unit for manufacturing an angled plug connector following the method according to the invention.

The above and other objects, which will be apparent to those skilled in the art, are achieved in the present invention which is directed to a method for assembling an angled plug connector with a plug connector housing comprising a through-channel, preferably angled at a right angle, designed to accommodate conductor components extending at an angle relative to one another, wherein a first conductor component introduced into the through-channel from one side (X) is, in the interior of the through-channel, connected in a form- and/or force-locking manner with a second conductor component which is introduced into the through-channel from the other side (Y), by the following steps: a) the first conductor component is held, in a force-locking manner, in an assembly position (I) in the through-channel from which it can be introduced further into the through-channel; b) the second conductor component is introduced into the through-channel from the other side (Y) as far as an end position (II); and c) the first conductor component is introduced further into the through-channel as far as an end position (III) and as a result is connected with the second conductor component.

The through-channel may be limited by an inner wall of the plug connector housing which is formed in a single piece.

The first conductor component is pressed together with the second conductor component in the interior of the through-channel. During the pressing an over-dimensioned, substantially tubular wall section of the first outer conductor is pressed into an opening of the second outer conductor. Furthermore, during the pressing together of the outer conductors, the inner conductor of the first conductor component is brought into electrical contact with the inner conductor of the second conductor component and is thereby connected with this, preferably in a form- or force-locking manner.

Each of the conductor components comprises at least one inner conductor and an outer conductor surrounding the inner conductor, at least in sections, wherein the outer conductors of the two conductor components are pressed together with one another.

The inner conductor of the first conductor component may have a pin-formed section protruding into the interior of the channel which is clamped in a clamping section of the inner conductor of the second conductor component.

The first conductor component may comprise an interface for coupling with a complementary mating plug connector, wherein the interface has an outer conductor, for example a spring bush, and an inner conductor held therein by an insulating part, and/or that the second conductor component is attached to one end of a coaxial cable and comprises an inner conductor and an outer conductor surrounding the inner conductor, at least in sections.

At least two sealing elements may be presented, accommodated in the through-channel, wherein one sealing element prevents the penetration of liquid into the interior of the channel from one side and/or the second sealing element prevents the penetration of liquid into the interior of the channel from one side when a mating plug connector is coupled with the angled plug connector.

In a second aspect, the present invention is directed to an assembly unit for manufacturing an angled plug connector, the assembly unit comprising: a plug connector housing with an angled through-channel designed to accommodate conductor components extending at an angle relative to one another; and a first conductor component which is introduced into the through-channel from one side (X) and is held therein, in a force-locking manner, in an assembly position (I) from which it can be pushed even further into the through-channel, and which is so designed that by inserting it further into the through-channel as far as an end position (III) it can be connected in a form- and or force-locking manner, in particular pressed together, with a second conductor component which is introduced into the through-channel from the other side (Y).

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

Figure 1:
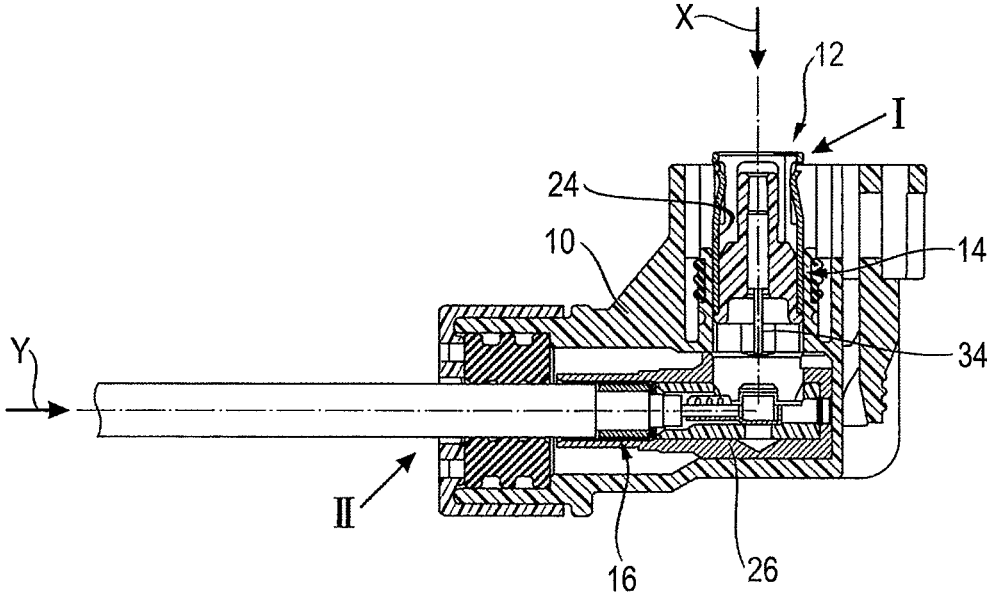
FIG. 1 shows an intermediate step in the assembly of an angled plug connector 100 using the method according to the invention, in a longitudinal sectional view.

In describing the preferred embodiment of the present invention, reference will be made herein to FIGS. 1-3 of the drawings in which like numerals refer to like features of the invention.

In a method for assembling an angled plug connector of the aforementioned kind, according to the invention the following steps are provided:

(a) the first conductor component is held, preferably in a force-locking manner, in an assembly position (I) in the through-channel from which it can be introduced further into the through-channel;

(b) the second conductor component is introduced into the through-channel from the other side as far as an end position (II); and (c) the first conductor component (14) is introduced further into the through-channel (12) as far as an end position (III) and as a result is connected with the second conductor component (16).

This leads to a particularly time-saving and user-friendly method for manufacturing an angled plug connector.

The method according to the invention is characterized in that a first conductor component introduced into the through-channel from one side is, in the interior of the through-channel, connected in a force- and/or form-locking manner with a second conductor component introduced into the through-channel from the other side. In other words, the first conductor component is introduced into the first channel section through a first channel opening, and the second conductor component is introduced into the second channel section, which is oriented at an angle to the first channel section, through the opposite second channel opening. By pressing or pushing the first conductor component further into the interior of the channel, in the direction of the bend point between the two channel sections, the two conductor components can be brought into electrical and mechanical contact with one another for the transmission of electrical signals and/or current and in this way can be connected with one another in a form- and/or force-locking manner. For example, the leading front ends of the two conductor components in the respective channel sections are clamped, pressed, locked, screwed (force-locking connection) and/or interlocked (form-locking connection) with one another, or similar, in the interior of the channel.

Each of the conductor components thereby comprises at least one electrical conductor which is introduced into the channel in the direction of the respective channel section, so that electrical signals and/or electrical current can be conducted from the cable-side end of the plug connector up to the plug interface on the plug-side end of the plug connector.

The invention is based on the knowledge that a cable with an angled conductor component already attached thereto can only be introduced into a channel of an angled housing which is open at the side, which leads to the problems with assembly already described. Therefore, according to the invention the first conductor component which is to be mounted at an angle to the cable is first connected with the second conductor component which is attached to the front end of the cable in the interior of the housing. This has the advantage that the two conductor components, which in each case substantially extend in a linear manner prior to assembly in the plug connector housing, can be introduced into a channel which is laterally closed on all sides from the two opposite channel openings which are necessary in any case and can only then be connected with one another, in the interior of the plug connector housing, in order to create the angled conductor path.

Since in this case the channel can be surrounded by an inner wall of the housing which is laterally closed on all sides, there is no need for a second housing shell or a housing cover in order to close the housing in a sealed manner following introduction of the angled conductor component. Instead, the housing with the angled channel can already be manufactured in a single piece from a watertight material, for example plastic, so that, following introduction of the conductor components, only the two channel openings need to be sealed in order to produce a completely watertight angled plug connector. The step of gluing together or sealing several housing parts, carried out on site by the installer of the plug connector, is also unnecessary.

In the assembly position (I), the first conductor component is held, in a force-locking manner, in a position in the first channel section provided for this purpose. For this purpose, the first conductor component can, at least in sections, lie closely against the inner channel wall of the first channel section. For example, the first conductor component has projections which project radially outwards, for example peripheral nubs, which press against the inner wall of the channel and hold or fix the first conductor component in the assembly position. This fixing is preferably so weak that the first conductor component can, by means of a pressing force directed into the interior of the channel, be pressed further into the first channel section in order to connect with the second conductor component. On the other hand, the fixing is sufficiently strong that the first conductor component cannot become detached from the plug connector housing and for example fall into the channel or out of the channel without a tangible application of force. In the assembly position (I), the first conductor component preferably only projects so far into the first channel section that this does not obstruct an introduction of the second conductor component into the second channel section as far as the end position.

In order to assemble the angled plug connector, the assembly unit is transported, with the first conductor component already held in the channel, to the location at which the plug connector is to be attached to the front end of a line or cable.

The line, with the second conductor component attached to the front end of the line, is then introduced into the second channel section until the second conductor component comes to rest against a limit stop in the channel and is then arranged in its axial end position.

The first conductor component which is already arranged in the first channel section is then pressed into the channel until it makes electrical and mechanical contact with the second conductor component in the region of the bend point of the channel and is preferably inseparably connected with this.

A particularly simple, quickly established and durable connection between the first and the second conductor component in the interior of the channel is made possible in that the first conductor component is pressed together with the second conductor component. A press-fit connection simply requires that a compressive force be applied to one of the conductor components in its longitudinal direction or in the longitudinal direction of the corresponding channel section. A press-fit connection is highly suitable for the transmission of electrical signals and/or currents due to the large contact surface created between the connection partners. Moreover, a press-fit connection is particularly robust and durable.

In a particularly preferred embodiment of the invention, the angled plug connector is a coaxial plug connector in which each of the conductor components comprises an inner conductor and an outer conductor which, at least in sections, surrounds the inner conductor. The outer conductor can form a shield for the inner conductor and/or, at least in sections, enclose the inner conductor in the manner of a sleeve or in the form of a spring bush or wire braid. Preferably, both the first conductor component and also the second conductor component have a coaxial structure with the inner conductor and the outer conductor surrounding this, wherein the inner conductors and the outer conductors of the two conductor components preferably extend substantially at right angles to one another.

In order to allow rapid and time-saving assembly, it has proved expedient if both the outer conductors and also the inner conductors of the two conductor components are connected with one another in the interior of the through-channel in a force and/or form-locking manner.

In order to achieve a stable mechanical connection between the two conductor components it has thereby proved advantageous if the outer conductors of the two conductor components are pressed together with one another, while the inner conductors are not necessarily pressed together with one another. A press-fit connection between the outer conductors, with their greater surface areas, is particularly stable and robust, while the inner conductors can easily be damaged through the force required in order to create a press-fit connection.

A reliable and particularly durable pressing-together of the two outer conductors is possible in that an oversized, substantially tubular wall section of the outer conductor of the first conductor component is pressed into an opening of the outer conductor of the second conductor component. In other words an interference fit (press fit) between the two outer conductors is created. The opening can be arranged in a press-fit section provided on the front end of the outer conductor of the second conductor component such that, following the introduction of the second conductor component into the second channel section, it points towards the first channel section and forms a continuation thereof, so that the first conductor component can be pressed into the opening without any problem by pressing it further forward into the channel.

The outer conductor of one or both conductor components can, at least in sections, consist of a metal suitable for pressing, for example a die-cast zinc or brass.

The pressing of the two outer conductors can be carried out quickly and simply by means of a transportable, preferably manually operable pressing tool, for example a toggle press or the like. This means that pressing can be carried out directly at the assembly location of the angled plug connector.

As already indicated, during the pressing of the outer conductors, the inner conductors of the two conductor components which are, at least in sections, surrounded by these are also at the same time brought into electrical and mechanical contact with one another and as a result connected with one another, preferably in a form- and/or force-locking manner. It is not thereby necessary also to press the inner conductors together with one another. Instead, the establishment of a force-locking contact between the two inner conductors, for example a simple clamping contact, can be sufficient to achieve a reliable electrical contact, while the mechanical strength of the connection can be guaranteed above all through the pressed contact between the outer conductors, which provides a much greater holding force.

A reliable electrical contact can be established between the two inner conductors when pressing the first conductor component into the second conductor component in that a pin-formed section of the inner conductor of the first conductor component is pushed forward into a clamping section of the inner conductor of the second conductor component and is clamped by this. The clamping section can comprise two or more deflectable spring tabs which are deflected on introduction of the pin-formed section and as a result are spring-loaded in the direction of said pin-formed section, so that a durable and extensive electrical contact is ensured.

An excellent water tightness of the angled plug connector can be guaranteed in that the through-channel adjoins an inner wall of the plug connector housing which is formed in a single piece. In other words, the entire plug connector housing with the angled through-channel can be formed in a single piece from a watertight material, for example plastic. This means that there is no need to glue together or seal a connection region between two or more housing parts where the method according to the invention is used.

The first conductor component preferably comprises the plug interface for coupling with a complementary mating plug connector and has a coaxial structure. In other words, the plug interface comprises an outer conductor, for example a spring bush or tubular section, and an inner conductor, preferably held centrally therein by an insulating part.

Alternatively or additionally, the second conductor component is attached at one end of a coaxial cable and substantially extends in the longitudinal direction of the cable, wherein the coaxial structure of the coaxial cable, with an inner conductor and an outer conductor surrounding the inner conductor, at least in sections, is continued through the second conductor component. Preferably, the second conductor component is crimped and/or soldered onto the front end of the coaxial cable such that the inner conductor of the cable makes electrical contact with the inner conductor of the second conductor component and the outer conductor of the cable makes electrical contact with the outer conductor of the second conductor component.

In order to prevent the penetration of liquid, for example water, into the through-channel of the plug connector housing it is expedient to arrange at least two sealing elements, for example sealing rings or the like, in the through-channel. One sealing element, which prevents the penetration of liquid into the interior of the channel from one side, preferably seals a gap between a cable and/or the second conductor component connected thereto and the inner wall of the through-channel. The second sealing element, which prevents the penetration of liquid into the interior of the channel from one side when a mating plug is connected with the angled plug connector, preferably serves to rest, in a sealing manner, against a housing section of a mating plug connector plugged into the channel opening of the first channel section.

According to a further aspect, the present invention relates to an angled plug connector manufactured using the method according to the invention. The angled plug connector can exhibit the features explained above individually or in any combination, whereby in order to avoid repetition reference is made to the explanations above.

The present invention also relates to an assembly unit for manufacturing an angled plug connector by means of the method according to the invention, wherein the assembly unit comprises: a plug connector housing with a through-channel, preferably angled at a right angle, designed to accommodate conductor components, and a first conductor component which is introduced from one side into the through-channel, where it is held in an assembly position from which it can be pushed even further into the through-channel, and which is so designed that, by pushing it further into the through-channel as far as an end position, it can be connected in a form- and or force-locking manner, in particular pressed together, with a second conductor component which is introduced into the through-channel from the other side.

The assembly unit can exhibit the features explained above individually or in any combination, whereby in order to avoid repetition reference is made to the explanations above.

In the following description, the invention is explained by way of example with reference to the enclosed drawings.

Figure 2:
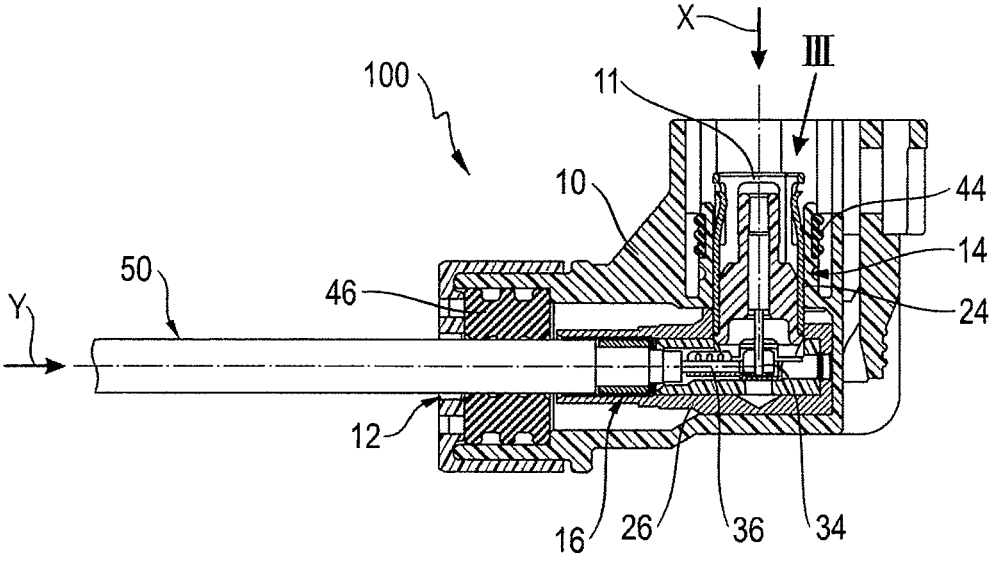
FIG. 2 shows an angled plug connector 100 finally assembled using the method according to the invention, in a longitudinal sectional view.
Figure 3:
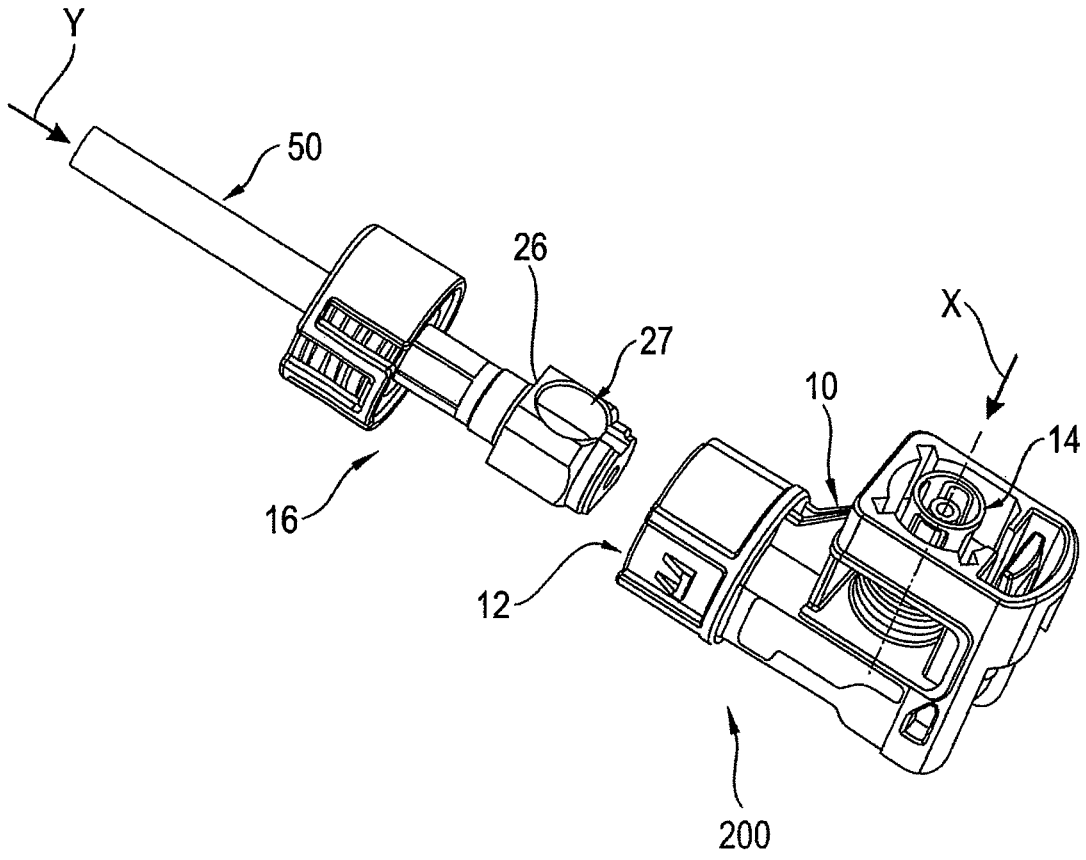
FIG. 3 shows an assembly unit 200 according to the invention for the manufacture of an angled plug connector 100 using the method according to the invention, in a perspective view.

FIGS. 1 to 3 show steps in carrying out a method according to the invention for assembling a watertight angled plug connector 100, wherein during assembly, starting out from the step shown in FIG. 3, via the step shown in FIG. 1, the angled plug connector illustrated in FIG. 2 is finally produced. A finally assembled angled plug connector is illustrated in longitudinal cross section in FIG. 2 and will be described first:

The angled plug connector 100 has a plug connector housing 10 made of plastic, through which a through-channel 12 angled at a right angle passes. A conductor assembly is accommodated in the through-channel 12 which is coupled to the front end of a coaxial cable 50.

The coaxial cable 50 enters the through-channel 12 at a cable-side end of the plug connector 100. On a plug-side end, the plug connector has a plug interface 11 for coupling the plug connector with a mating plug connector (not shown).

The conductor assembly consists of two conductor components 14, 16, of which the second conductor component 16 is connected, electrically and mechanically, at the end of the coaxial cable 50 and extends into a first channel section which continues further in the longitudinal direction of the cable 50. The end of the second conductor component 16 protruding into the channel 12 is connected electrically and mechanically with the first conductor component 14, wherein the longitudinal axis of the first conductor component 14 is oriented substantially perpendicular to the longitudinal axis of the second conductor component 16. The first conductor component 14 is arranged in a first channel section oriented substantially perpendicular to the second channel section and contains the plug interface 11 for coupling with the mating plug connector. The two conductor components 14, 16 are connected with one another, preferably inseparably, in the region of the bend point between the first channel section and the second channel section.

The inner conductor of the coaxial cable is connected (for example through crimping or soldering) with an inner conductor 36 of the second conductor component 16 which has at its front end a clamping section for clamping a pin-formed section of an inner conductor 34 of the first conductor component 14. In this case, by way of example the inner conductor 34 of the first conductor component has on the plug-side end an inner conductor socket.

The outer conductor of the coaxial cable is connected (preferably through crimping) with an outer conductor 26 of the second conductor component 16 which has at its front end a press-fit section 27 with an opening for pressing in an outer conductor 24 of the first conductor component 14. In this case, by way of example the outer conductor 24 of the first conductor component has on its plug-side end a spring bush for making contact with an outer conductor of the mating plug connector.

Due to a sealing element 46, lying against the coaxial cable 50 in a sealing manner and surrounding this, which is arranged on the cable-side end of the plug connector in the interior of the through-channel 12, no water can penetrate into the second channel section.

Also, a penetration of water into the first channel section is prevented through a further sealing element 44 which lies against a housing of the mating plug connector in a sealing manner when this is coupled with the plug connector 100.

Since the inner wall of the through-channel 12 between the two sealing elements 44, 46 is otherwise formed in a single part and has no glued points or other connection points between two or more housing parts, the angled plug connector has excellent watertight properties.

The method according to the invention for assembling the angled plug connector 100 is explained in the following:

First, an assembly unit 200 is provided, as shown on the right in FIG. 3. The assembly unit 200 comprises the plug connector housing 10 formed in a single piece and the first conductor component 14 held in the first channel section of the through-channel 12. As can clearly be seen in FIG. 2, the first conductor component 14 consists of the, at least in sections, tubular outer conductor 24 and the inner conductor 34 held centrally therein by an insulating part.

The channel diameter of the first channel section is selected such that the first conductor component 14 introduced from one side X of the channel 12 is held in a force-locking manner by the channel wall without slipping further into the channel 12 or falling out again. In the assembly position I shown in FIG. 1, the first conductor component is held in the first channel section in which it does not yet protrude into the second channel section, so that the second conductor component 16 can without any problem be introduced into the second channel section from the other side Y of the channel as far as an end limit stop without coming into contact with the first conductor component 14.

As shown in FIG. 3, the second conductor component 16 attached to the front end of the coaxial cable 50 is introduced by the cable installer into the second channel section from the other side Y until it meets the end limit stop and is then arranged in the end position II shown in FIG. 1. The second conductor component 16 shown particularly clearly in FIG. 3 comprises the outer conductor 26 with the press-fit section 27 on its front end and the inner conductor 36 held roughly centrally therein by an insulating part with the clamping section on its front end, which is accessible via an opening in the press-fit section 27. In the end position II, the opening of the press-fit section 27 faces the first channel section and points in the direction of the first conductor component 14 held therein.

As illustrated in FIG. 2, the first conductor component 14 is now pressed further into the through-channel 12 by means of a press, for example a hand press, wherein the foremost, for example tubular wall section of the outer conductor 24 of the first conductor component 14 is thereby pressed into the opening of the press-fit section 27 of the outer conductor 26 of the second conductor component 16. Due to the over-dimensioning of the tubular wall section, an inseparable press-fit is created between this and the press-fit section 27. At the same time, the pin-formed section of the inner conductor 34 is pushed into the clamping section of the inner conductor 36, which is provided with spring tabs.

This means that the press-connection between the two conductor components 14, 16 can be carried out quickly and without any problem on site by the cable installer in the interior of the through-channel 12, so that multiple-part plug connector housings and the problems in terms of water tightness and assembly associated with these are unnecessary.

The invention also relates to the assembly unit 200, as illustrated on the right in FIG. 3.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A method for assembling an angled plug connector with a plug connector housing comprising a through-channel angled at a right angle and designed to accommodate conductor components extending at an angle relative to one another, wherein a first conductor component introduced into the through-channel from one side (X) is, in the interior of the through-channel, connected in one of a form- or force-locking manner with a second conductor component which is introduced into the through-channel from an other side (Y), said method including the following steps in the order named:

a) the first conductor component is held, in a force-locking manner, in an assembly position (I) in the through-channel from which it can be introduced further into the through-channel;

b) the second conductor component is introduced into the through-channel from the other side (Y) and comes to rest against a limit stop at a first end position (II), wherein said second conductor component is connected electrically and mechanically at an end of a coaxial cable; and c) the first conductor component is introduced further into the through-channel as far as a second end position (III) where the first conductor component is connected in a one of the form- or the force-locking manner with the second conductor component.

2. The method of claim 1, wherein the through-channel is limited by an inner wall of the plug connector housing which is formed in a single piece.

3. The method of claim 1, wherein the first conductor component is pressed together with the second conductor component in the interior of the through-channel.

4. The method of claim 3, wherein each of the conductor components comprises at least one inner conductor and an outer conductor surrounding the inner conductor, at least in sections, wherein the outer conductors of the first and the second conductor components are pressed together with one another.

5. The method of claim 4, wherein during pressing an over-dimensioned, substantially tubular wall section of the first outer conductor is pressed into an opening of the second outer conductor.

6. The method of claim 4, wherein during pressing together of the first and the second outer conductors, the inner conductor of the first conductor component is brought into electrical contact with the inner conductor of the second conductor component, preferably in a form- or force-locking manner.

7. The method of claim 6, wherein the inner conductor of the first conductor component has a pin-formed section protruding into the interior of the channel which is clamped in a clamping section of the inner conductor of the second conductor component.

8. The method of claim 3, wherein during pressing an over-dimensioned, substantially tubular wall section of the first outer conductor is pressed into an opening of the second outer conductor.

9. The method of claim 8, wherein during pressing together of the first and second outer conductors, the inner conductor of the first conductor component is brought into electrical contact with the inner conductor of the second conductor component, preferably in a form- or force-locking manner.

10. The method of claim 9, wherein the inner conductor of the first conductor component has a pin-formed section protruding into the interior of the channel which is clamped in a clamping section of the inner conductor of the second conductor component.

11. The method of claim 10, wherein the through-channel is limited by an inner wall of the plug connector housing which is formed in a single piece.

12. The method of claim 1, further including at least two sealing elements, accommodated in the through-channel, wherein one sealing element prevents the penetration of liquid into the interior of the channel from one side and the second sealing element prevents the penetration of liquid into the interior of the channel from one side when a mating plug connector is coupled with the angled plug connector.

13. The method of claim 12 wherein said at least two sealing elements comprise sealing rings.

14. The method of claim 1, wherein the first conductor component comprises an interface for coupling with a complementary mating plug connector, wherein the interface has an outer conductor, for example a spring bush, and an inner conductor held therein by an insulating part.

15. The method of claim 14, including attaching the second conductor component to one end of a coaxial cable and comprising an inner conductor and an outer conductor surrounding the inner conductor, at least in sections.

16. The method of claim 4, wherein the first conductor component comprises an interface for coupling with a complementary mating plug connector, wherein the interface has an outer conductor, for example a spring bush, and an inner conductor held therein by an insulating part.

17. The method of claim 16, including attaching the second conductor component to one end of a coaxial cable and comprising an inner conductor and an outer conductor surrounding the inner conductor, at least in sections.

18. An assembly unit for manufacturing an angled plug connector, said assembly unit comprising:

a plug connector housing with an angled through-channel designed to accommodate conductor components extending at an angle relative to one another; and a first conductor component which is first introduced into the through-channel from one side (X) and is held therein, in a force-locking manner, in an assembly position (I) from which it can then be pushed even further into the through-channel, and which is so designed that by inserting it further into the through-channel as far as an end position (III) it can next be connected in one of a form- or force-locking manner, in particular pressed together, with a second conductor component which is introduced into the through-channel from an other side (Y), and wherein said second conductor component is connected electrically and mechanically at an end of a coaxial cable.

* * * * *